US005790151A

United States Patent [19]

Mills

[11] Patent Number: 5,790,151

[45] Date of Patent: Aug. 4, 1998

[54] INK JET PRINTHEAD AND METHOD OF MAKING

[75] Inventor: Ross Neal Mills, Boulder, Colo.

[73] Assignee: imaging Technology international Corp., Boulder, Colo.

[21] Appl. No.: 622,815

[22] Filed: Mar. 27, 1996

[51] Int. Cl.[6] ..... B41J 2/14

[52] U.S. Cl. ..... 347/47; 216/27

[58] Field of Search ..... 347/45, 47; 216/27

[56] References Cited

U.S. PATENT DOCUMENTS

| | | | |
|---|---|---|---|
| 4,169,008 | 9/1979 | Kurth . | |
| 4,528,070 | 7/1985 | Gamblin . | |
| 4,542,386 | 9/1985 | Delligatti et al. | 347/45 |
| 4,716,423 | 12/1987 | Chan et al. . | |
| 4,728,392 | 3/1988 | Miura et al. . | |
| 4,801,995 | 1/1989 | Iwanishi . | |
| 5,006,202 | 4/1991 | Hawkins et al. . | |
| 5,041,190 | 8/1991 | Drake et al. . | |
| 5,598,195 | 1/1997 | Okamoto et al. . | |

FOREIGN PATENT DOCUMENTS

| | | | |
|---|---|---|---|
| 04299150 | 10/1992 | Japan | 347/47 |
| 94027825 | 12/1994 | WIPO | 347/47 |

*Primary Examiner*—Valerie Lund

*Attorney, Agent, or Firm*—F. A. Sirr; E. C. Hancock; Holland & Hart llp

[57] ABSTRACT

An ink jet printhead includes a nonconductive substrate into which a plurality of tapered nozzle holes are formed with the wide hole area coincident with an ink entry side and with the marrow hole area coincident with an ink exit side, and with an ink reservoir mounted on the ink entry side. A metal layer covers the interior of each nozzle hole, and also provides an electrical control-signal conductor on the ink entry side for each metallized nozzle hole. The metal layer also provides a tubular metal extension for each metallized nozzle, these extensions extending a common distance beyond the ink exit side. A plurality of metal conductors may be provided on the ink exit side to facilitate nozzle control using signal-multiplexing techniques, or a field compensation electrode may be provided on the ink exit side.

30 Claims, 19 Drawing Sheets

INK JET PRINTHEAD AND METHOD OF MAKING

CROSS REFERENCE TO RELATED APPLICATION

Copending U.S. patent application Ser. No. 08/551,907, filed on 12 Oct., 1995 by R. N. Mills, J. E. Kerr and J. B. Febvre, and entitled SHADOW PULSE COMPENSATION OF AN INK JET PRINTER, is hereby incorporated by reference.

BACKGROUND OF THE INVENTION

1. Field of the Invention

This invention pertains to the field of electrostatic ink jet printing, and more specifically, to multi-nozzle ink jet printheads, and to methods of making the same.

2. Description of Related Art

In the field of electrostatic ink jet printing, a relatively large quantity of the printing medium or ink is held in a reservoir that communicates with the input side of a multi-nozzle printhead. An electrical control signal that is applied to the array of nozzles causes very small quantities of the ink to deform from the exit side of signal selected nozzles, as is caused by the presence of an electrostatic field, so as to form what is known as a "Taylor cone" at the selected nozzles of the array. When the electrostatic field that is effective at any given nozzle reaches a given or critical level, a thin filament, or strand, of ink leaves the printhead, and travels to impact an adjacent print substrate.

Nonlimiting examples of a printing medium are liquid ink, liquid toner, dry toner, dry powder, and the like, hereinafter collectively called ink. Nonlimiting examples of a print substrate are a final substrate, such as plain paper and the like, or an intermediate substrate on which the ink is first deposited, and from which the ink is thereafter transferred to a final print substrate, such as plain paper, hereinafter collectively called print substrate.

In electrostatic printers of this general type, a stationary printhead is usually mounted closely adjacent to a moving print substrate. The printhead usually comprises a plurality of individually controllable nozzles that are aligned in a direction that extends generally perpendicular to the direction of movement of the print substrate. The direction of movement of the print substrate can be said to define the columns of print pixels that may be selectively printed on the print substrate, whereas the direction in which the nozzles extend can be said to define the rows of print pixels that may be selectively printed on the print substrate. The number of pixel columns per page of print substrate is usually established by the physical nozzle arrangement within the printhead, whereas the number of pixel rows per page of print substrate is usually established by controlling the printhead to emit ink in synchronism with movement of the print substrate.

It is generally known in the art to produce multi-nozzle printhead using both electroforming techniques, silicon processing techniques, and etching techniques.

U.S. Pat. No. 4,728,392, and its divisional U.S. Pat. No. 4,801,995 describes a printhead having, considered in the direction of ink movement, an ink container 6, an electrically conductive pipe 6*a*, an ink chamber 5, a rear nozzle plate 7 having a projecting nozzle 8, a laminar air-flow chamber 10*a*, and a ring electrode that is aligned with the projecting nozzle. A signal source is connected between the pipe and the ring electrode. The rear nozzle plate is formed of an insulating material, and etching processes are used to form the projecting nozzle.

U.S. Pat. No. 4,716,423 describes a thermal ink jet printhead, wherein a barrier layer and orifice plate assemble are made using electroforming techniques.

U.S. Pat. No. 4,528,070 describes making orifice plates from a metal substrate by using chemical etching techniques.

U.S. Pat. Nos. 4,169,008, 5,006,202 and 5,041,190 describe nozzle plates for ink jet printing that are produced using silicon, or the like material, and wherein nozzles are produced using etching techniques.

While prior printhead apparatus/methods as exemplified above are generally satisfactory for their limited intended purposes, the need remains in the art for an improved printhead that includes a nonconductive substrate having a plurality of ink jet nozzles preformed or molded therein, the substrate having an ink entrance side, and an ink exit side, with each of the nozzles being cone-shaped, with the cone's large-area being coincident with the ink entrance side and with the cone's small-area being coincident with the ink exit side. A first metal is coated on all surfaces of the substrate. This first metal is then processed to (1) form an exposed circle of the first metal surrounding each nozzle coincident with its large-area portion, (2) form an exposed electrical conductor of the first metal on the entrance side and leading to each of the exposed circles, (3) form cone-shape of with first metal for each nozzle, and (4) form an exposed circle of the first metal surrounding each nozzle coincident with its small-area portion. A second metal is now plated on each of the circles, the electrical conductors, and the cone shapes, after which the exit side of the substrate is lapped to remove the metal that is on the exit side. The exit side of the substrate is now etched to remove a portion thereof, and to thereby produce tubular metal projections for each of the metal nozzles, these protrusions extending beyond the exit side of the substrate.

SUMMARY OF THE INVENTION

This invention provides a new and unusual multi-nozzle ink jet printhead, and methods of making the same. In a multi-nozzle ink jet printhead in accordance with this invention, a relatively large quantity of ink is held in a reservoir that is mounted to the printhead at a location that is generally adjacent to the ink entry side of a generally flat or planar multi-nozzle array. Electrical potential applied to the nozzle array, for example, as is taught in the above-mentioned copending patent application incorporated herein by reference, causes a very small quantity of ink to deform from the ink exit side of potential-selected nozzles. When the electrostatic field that is effective at any given nozzle reaches a critical level, a filament of ink leaves that nozzle, and travels to impact closely corresponding given pixel of an adjacent print substrate. While the present invention will be described relative to electrostatic printheads, such as are used in well-known drop-on-demand ink jet printing systems, its utility is not to be limited thereto.

While preferred embodiments of the present invention will be described while making reference to embodiments that relate to the use of electroforming techniques, other embodiments of the invention will be described that relate to the use of silicon processing techniques.

In summary, when using electroforming techniques, an array of nozzles in accordance with an embodiment of the invention, are produced by starting with a generally planar plastic plate into which a plurality of spaced and conical-shaped nozzle holes have been preformed; for example, by molding of the plastic plate, by laser drilling of the plastic plate, or by chemical etching of the plastic plate. Without limitation thereto, in a preferred embodiment, such a plastic plate was formed of the LEXAN or ULTAM brands of a thermoplastic carbonate-linked polymer that is formed by reacting bisphenol A and phosgene; i.e., a polycarbonate resin.

These cone-shaped nozzle holes are oriented so that the large, or wide cross-sectional area of each cone is coincident with the ink entry side of the plastic plate, and so that the small or narrow crosssectional area of each cone is coincident with the ink exit side of the plastic plate.

A thin, electrical conductive, seed-metal layer (for example, chromium flash followed by copper) is then vacuum deposited, or coated, on all surfaces, or at least on the ink entry surface, the ink exit surface, and the cone surfaces, of the plastic plate, for example, by the use of a thermal evaporation process, or more preferably by the use of a sputtering process.

This seed-metal-coated plastic plate is then photoresist processed so as to (1) form a plurality of seed-metal nozzle cones, one for each nozzle hole, (2) form a like plurality of large annular seed-metal rings and electrical conductors or wires that individually surround, and physically lead away from, each individual seed-metal nozzle cone on the ink entry side of the plastic plate, and (3) form a like plurality of small seed-metal rings that individually surround each individual seed-metal nozzle cone on the ink exit side of the plastic plate.

The plastic plate is then emersed in a plating bath (for example, a nickel-cobalt plating bath), and plated. After rinsing, the plastic plate is then preferably plated with a thin layer of gold, whereupon the plastic plate is rinsed and dried.

In order to provide a flat ink exit surface for the finished printhead, and in order to remove the seed-metal rings thereon, it is now desirable to lap the ink exit side of the plastic plate.

The plastic plate is now full surface etched on the ink exit side thereof so as to remove the plastic material to a depth of from about 25 to about 250 micrometers; for example, by E-beam etching or reactive ion (REI) etching. This step of the process leaves a similar-dimension metal protrusion for each metal nozzle cone, these protrusions extending a common distance beyond the now-etched ink exit side of the plastic plate.

An object of this invention is to provide an ink jet printhead, having an electrically nonconductive substrate into which a plurality of cone-shaped nozzle holes have been preformed, with the wide cone area coincident with the substrate's ink entry side, and with the marrow cone area coincident with the substrate's ink exit side. A thin metal coating covers the interior of each of the nozzle holes, also provides an plurality of electrical conductors on the substrate's ink entry side, one conductor for each metal cone, and also provides a metal extension of each metal cone that extends beyond the substrate's ink exit side. In an embodiment of the invention, a plurality of electrical conductors may be provided on the substrate's exit side to facilitate nozzle control using signal multiplexing. In addition, a field compensation electrode may be provided on this ink exit side, as is taught in the above-mentioned copending patent application.

More specifically, it is an object of the present invention to provide a printhead having a flat and electrically nonconductive substrate having a number of cone-shaped ink jet nozzles preformed therein, wherein a first metal layer is coated on all surfaces of the substrate, or at least on the ink entry side, the ink exit side, and the nozzle cones thereof, wherein the first metal layer is thereafter selectively removed to leave a circle of the first metal layer that surround each individual nozzle cone on the cone's ink entry side, to leave electrical conductors of the first metal layer on the ink entry side, each individual conductor extending away from an individual metal circle for the purpose of facilitating the selective application of control voltages to each nozzle cone, wherein a second metal is then coated on each of the metal circles, metal conductors, and metal nozzle cones, wherein the ink exit side of the substrate is then full surface lapped, and wherein the ink exit side of the substrate is then full surface etched to remove a depth its ink exit side, thus leaving short and generally circular-cylinder shaped metal extensions of each of the metal cone shaped ink jet nozzles, these metal extensions extending a common distance beyond the now-etched ink exit side of the substrate by an amount that is equal to amount of this surface that was removed by the full surface etching thereof.

These and other objects, advantages and features of the present invention will be apparent to those of skill in the art upon reference to the following detailed description preferred embodiments of the invention, which description makes reference to the drawing.

BRIEF DESCRIPTION OF THE DRAWING

FIGS. 14–19 show a silicon embodiment of the invention, wherein FIG. 14 is a side view of a silicon semiconductor substrate having two square, cross-section nozzle holes etched therein, as shown in the section view of FIG. 15, wherein FIG. 16 shows two photoresist disks that have been deposited on the ink exit side of the silicon substrate, wherein FIG. 17 shows the silicon substrate after a depth of the silicon substrate has been removed from the ink exit side thereof, wherein FIG. 18 shows a finished silicon substrate having two metal nozzles, and wherein FIG. 19 is a top view, or ink entry surface view, of FIG. 18.

DESCRIPTION OF THE PREFERRED EMBODIMENTS

The multi-nozzle ink jet printhead of the present invention, to be described in detail, preferably comprises a X-Y planar nozzle array that comprises a relatively large number of individually controllable nozzles. For example, a number of generally parallel and multi-nozzle rows extend in the X direction that is shown by coordinate system 10 of FIG. 1. Without limitation thereto, such a printhead is usually mounted at a stationary position, closely adjacent to a moving print medium (not shown) that moves in the Y direction. Ink filaments are selectively caused to move in the Z direction, these ink filaments traveling from selected printhead nozzles to thereafter deposit ink on selected pixels on the print substrate. As is well known by those skilled in the art, selection of individual nozzles for emitting an ink filament may be made in accordance with a page map memory that electronically defines the printed content of a printed page.

Equal increments of the Y direction of movement of the print substrate operate to define the X direction rows of pixels to be selectively printed on the print substrate, whereas the X direction physical spacing of the individual nozzles operate to define the Y direction columns of pixels that may be selectively printed on the print substrate; for example, one Y direction pixel column per nozzle. That is, the number of Y direction pixel columns per printed page is generally established by the physical spacing of the individual nozzles within the printhead, whereas the number of X direction pixel rows per printed page is generally established by controlling the printhead to emit ink in synchronism with the Y direction of movement of the print substrate.

Figure 1:
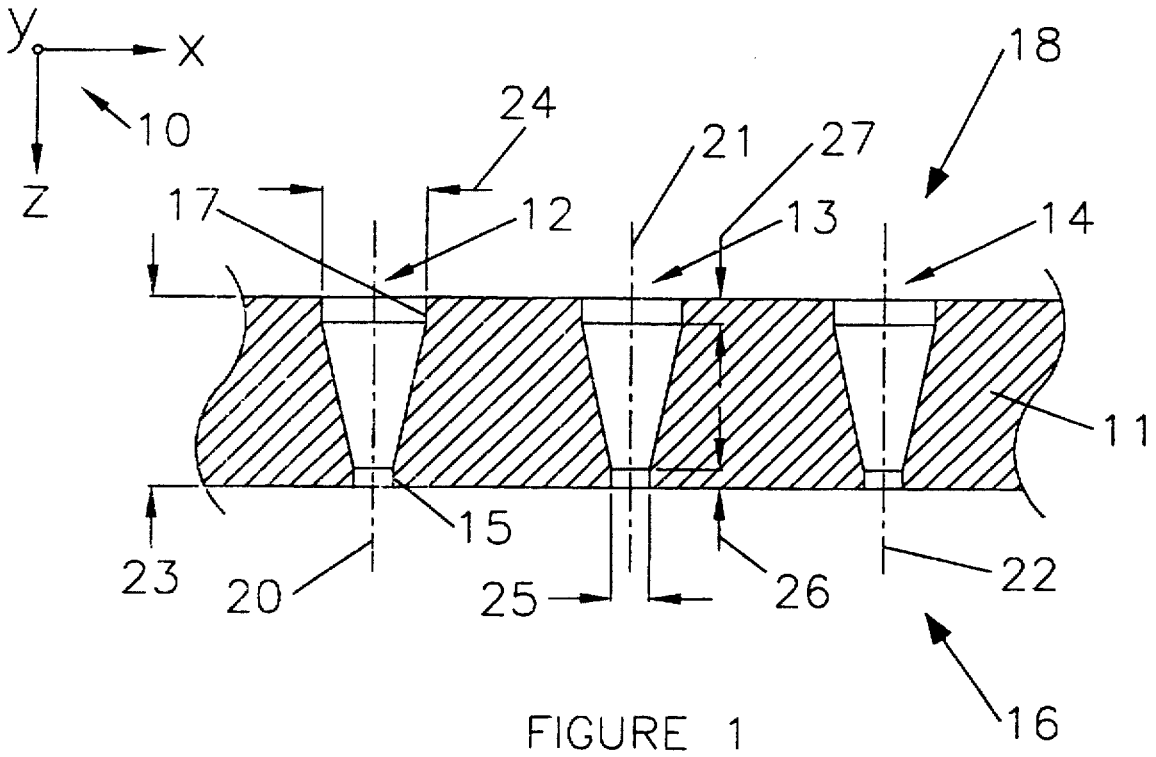
FIG. 1 is a cross section side view of a flat, electrically nonconductive, substrate or plate member from which a printhead in accordance with the present invention is formed using electroforming techniques, this exemplary substrate having three cone-shaped ink jet nozzle holes preformed therein.

FIG. 1 is a cross-section side view of a flat, electrically nonconductive, substrate plate or member 11 from which a printhead in accordance with the invention is formed using electroforming techniques. For purposes of simplicity only, substrate 10 is shown as having only three cone-shaped ink jet nozzles, or holes, 12,13,14 preformed therein, wherein nozzles 12,13,14 are aligned in the X direction, and wherein the central axis 20,21,22 of each individual cone-shaped nozzle 12,13,14 extends in the Z direction; i.e., central axes 20,21,22 are parallel.

As used herein, the term cone-shaped nozzle is intended to mean not only nozzles 12,13,14 having a conventional circular cross section when viewed in the X-Y plane of FIG. 1, that is a shape that is formed by rotating a right-triangle about a triangle leg that extends in the Z direction, but this term is also intended to include a cone-shaped nozzle having other X-Y planar cross-sectional shapes; for example, triangular, square or rectangular cross sectional shapes.

Whatever cross section cone shape is selected for use in this invention, it is critical that the selected cone shape be truncated so as to provide a small cross sectional area 15 at the ink exit side 16 of the printhead and of substrate 11, and so as to provide a larger cross-sectional area 17 at the ink entry side 18 of the printhead and of substrate 11. Preferably, the ink entry side 18 and the ink exit side 18 of substrate 11 lie in physically spaced and parallel X-Y planes.

In accordance with a preferred embodiment of the invention, substrate 11 was formed of a structurally stable and electrically nonconductive engineering plastic, such as the brand Lexan polycarbonate, in which cone-shaped nozzles 12,13,14 were preformed as by molding, laser drilling or chemical etching.

Without limitation thereto, in a preferred embodiment of the invention, the Z direction thickness 23 of substrate 11 was about 0.028-inch, the diameter 24 of each large cone area 17 was about 0.015-inch, the diameter 25 of each small cone area 15 was about 0.0065-inch, the small cone areas 15 terminated in a circular cylinder portion having a Z direction dimension 26 of about 0.004-inch, and the large cone areas 17 terminated in a circular cylinder portion having a Z direction dimension 27 of about 0.005-inch.

Figure 2:
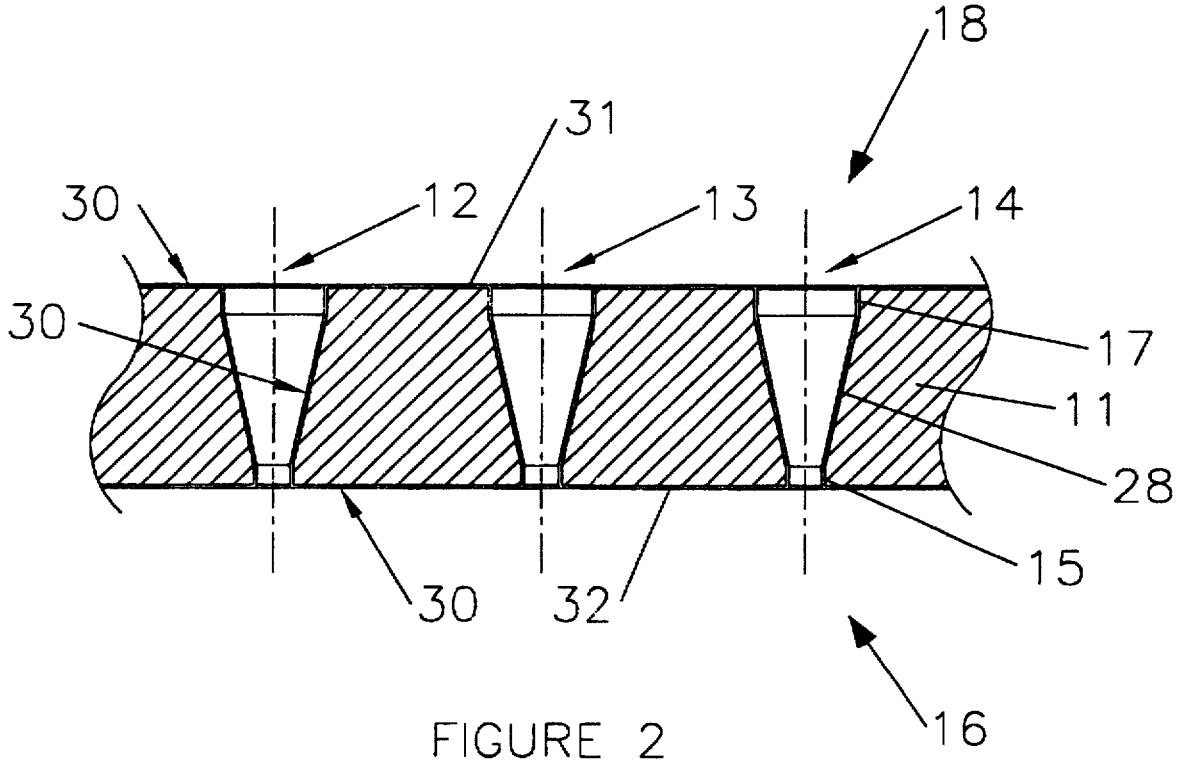
FIG. 2 is a side view of the substrate of FIG. 1 after a first metal layer has been coated on all surfaces thereof, or at least on the ink entry side, the ink exit side, and the three nozzle cones thereof.

FIG. 2 is a side view of substrate 11, similar to FIG. 1, after a first metal layer 30 has been coated on all surfaces thereof, or at least on the ink entry side 18, the ink exit side 16, the internal surfaces of the three cones 12,13,14. First metal layer 30 comprises an electrically conductive seed-metal layer that is quite thin, for example about 3,000 angstroms thick.

Metal layer 30 is preferably vacuum deposited (for example, by using sputtering or thermal evaporation processes, well known to those of skill in the art). In an embodiment of the invention, layer 30 comprised chromium flash layer, followed by deposition of a copper layer.

As is apparent from FIG. 2, each individual cone-shaped metal nozzle, when considered from the ink entry side 18 to the ink exit side 16, consists of a unitary metal surface having three portions; i.e., a circular cylinder 17, a conical surface 28, and a smaller circular cylinder 15. The upper end of circular cylinder 17, i.e., the end that is coincident with ink entry side 18, is continuous with the layer of first metal 30 that coats the full surface of ink entry side 18, whereas the lower end of circular cylinder 15, i.e., the end that is coincident with ink exit side 16, is continuous with the layer of first metal 30 that coats the full surface of ink exit side 16.

Figure 3:
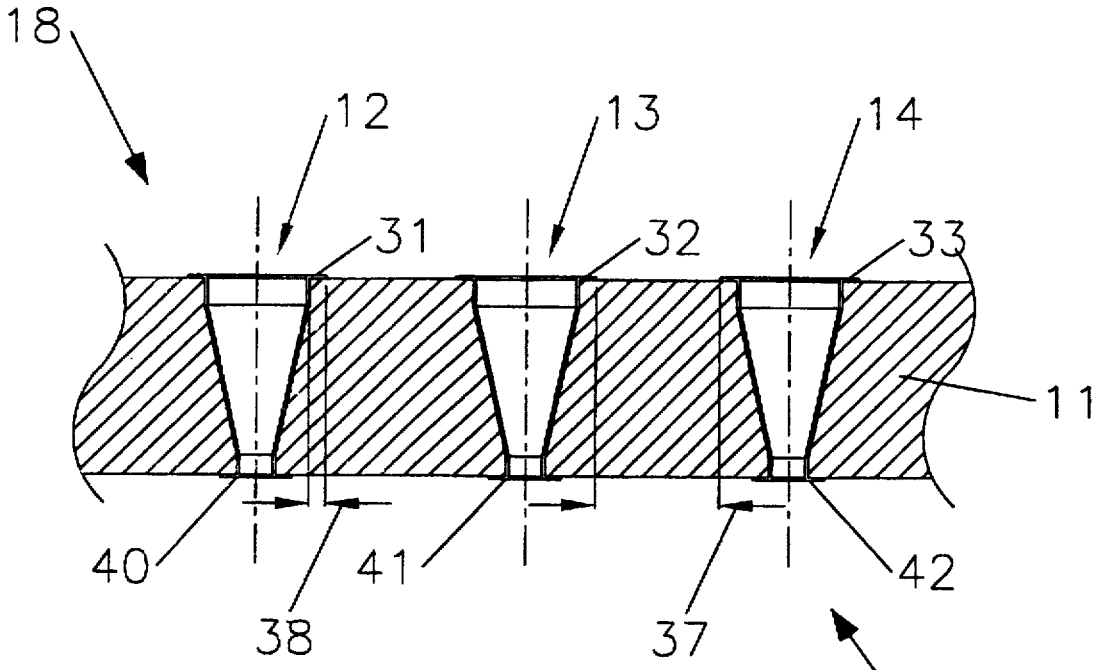
FIG. 3 is side view of the substrate of FIG. 2 after the first metal layer shown in FIG. 2 has been selectively removed, by the use of photoresist and metal etching techniques, so as to leave three circles of the first metal layer that individually surround, and are continuous with, the three individual metal nozzle cones on the cone's ink entry side, so as to provide three electrical conductors (not shown in FIG. 3) of the first metal layer, each electrical conductor extending away from an individual metal circle for the purpose of facilitating the selective application of individual control voltages to the three metal nozzle cones, and so as to leave three circles of the first metal layer that individually surround, and are continuous with, the three individual metal nozzle cones on the cone's ink exit side.
Figure 4:
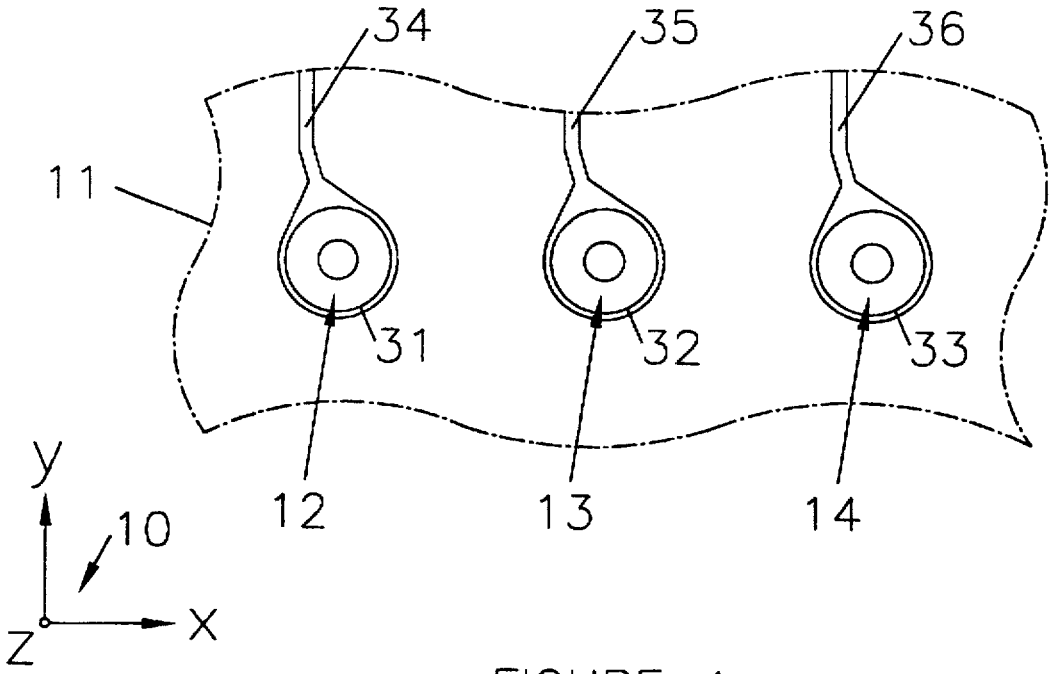
FIG. 4 is a top view of FIG. 3, this view showing the three electrical conductors that are formed on the cone's ink entry side.

With reference to FIGS. 3 and 4, FIG. 3 is a side view of substrate 11, similar to FIG. 2, and FIG. 4 is a top or ink entry view of substrate 11, after the first metal layer 30 that is shown in FIG. 2 has been selectively removed, by the use of well-known photoresist and metal etching techniques. In an embodiment of the invention, substrate 11 of FIG. 2, full surface coated with metal 30, was full surface covered with a positive working photoresist, selected areas of the photoresist were exposed, the exposed areas of photoresist were removed as by etching, and the resulting uncovered areas of metal layer 30 were removed.

This well-known photoresist/metal-etch process operates to leave three circles 31,32,33 of metal layer 30 on ink entry side 18, these three metal circles 31,32,33 individually surrounding and being continuous with the ink entry side of the three individual metal nozzle cones 12,13,14. In addition, ink entry side 18 also is now provided with three individual electrical conductors 34,35,36 of metal 30, as shown in the top view of FIG. 4. As shown in FIG. 4, each electrical conductor 34,35,36 extends away from an individual one of metal circles 31,32,33, these electrical conductors being provided for the purpose of facilitating the selective application of individual control voltages to the three metal nozzle cones 12,13,14.

By way of example only, in an embodiment of the invention, the edge-to-edge spacing 37 of adjacent metal circles 12,13,14 was about 0.012-inch, and the radial thickness 38 of each metal circle 12,13,14 was about 0.004-inch.

In addition, in an embodiment of the invention, the above-described photoresist/metal-etch process operated to leave a small metal ring 40,41,42 for each of the metal nozzle cones 12,13,14 on at the ink exit side 16 thereof. Metal rings 40,41,42 are provided for the purpose of ensuring adequate plating of a second metal layer, these rings will be removed by subsequent processing of substrate 11.

Figure 5:
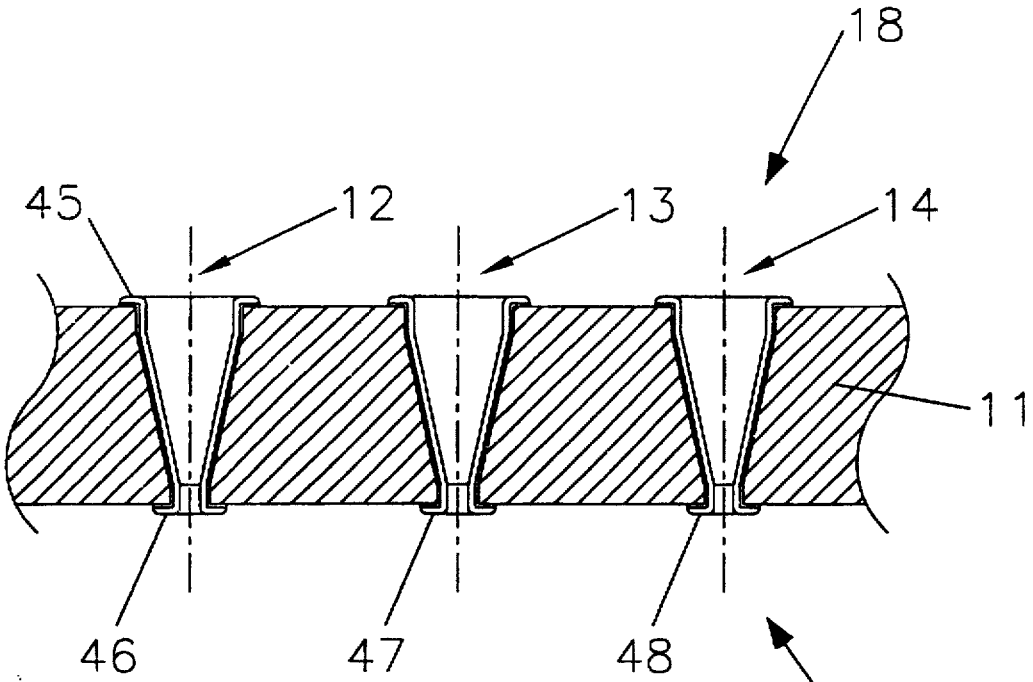
FIG. 5 is a side view of the substrate of FIGS. 3,4, wherein a second metal has been plated on each of the six metal circles, the three metal conductors, and the three metal nozzle cones of FIGS. 3,4.

FIG. 5 is a side view of substrate 11 of FIGS. 3,4, wherein a second metal 45 has been plated on each of the three metal circles 31,32,33, the three metal conductors 34,35,36, the three metal nozzle cones 12,13,14, and the three metal rings 40,41,42 of FIGS. 3,4. FIG. 5 also shows that after plating with this second metal 45, a metal stub 46,47,48 protrudes from the ink exit side 16 of the three metal nozzle cones 12,13,14.

By way of example only, in an embodiment of the invention, substrate 11 of FIGS. 3 and 4 was first immersed in a nickel-cobalt plating bath, and metal 30 was plated with a nickel-cobalt layer, to thereby form a first portion of the second metal. After rinsing, a thin layer of gold was preferably plated on the above-described nickel-cobalt layer, to thereby complete the second metal layer. Thereafter, the assembly of FIG. 5 was rinsed and dried. The use of a top gold layer is preferred for the purpose of inhibiting corrosion.

Figure 6:
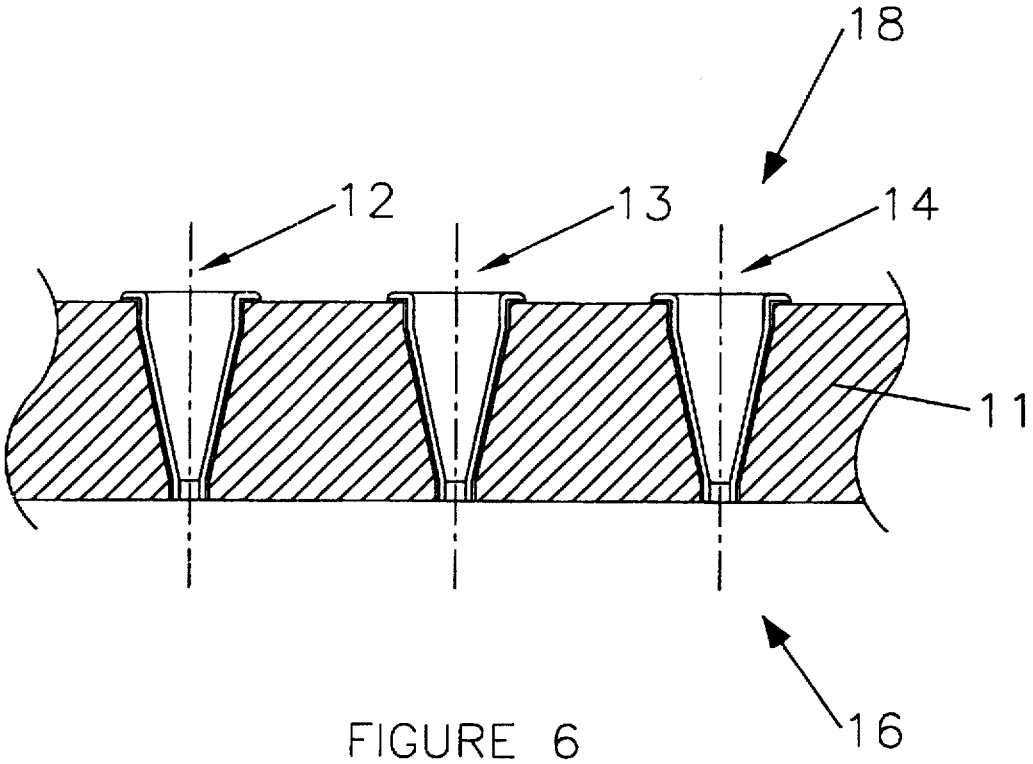
FIG. 6 is a side view of the substrate of FIG. 5, wherein the ink exit side of the substrate has been full surface lapped to thereby remove the three metal rings from the ink exit side of the three metal nozzle cones shown in FIG. 5.

In the next step of making a substrate 11 in accordance with the present invention, the ink exit side 16 of substrate 11, as shown in FIG. 5, is full surface lapped, using well-known techniques. FIG. 6 is a side view of substrate 11 of FIG. 5 after the ink exit side 16 thereof has been full surface lapped, to thereby remove metal protrusions 46,47, 48 that are shown in FIG. 5. This lapping process operates primarily to remove metal protrusions 46,47,48, and may incidently remove a small portion of substrate 11 on the ink exit side 16 thereof.

As the last step in making a substrate 11 in accordance with the present invention, the ink exit side 16 of substrate 11, as shown in FIG. 6, first full surface lapped to remove metal portions 46,47,48 and thereafter substrate 11 is full surface etched to remove a uniform portion of that side of substrate 11.

Figure 7:
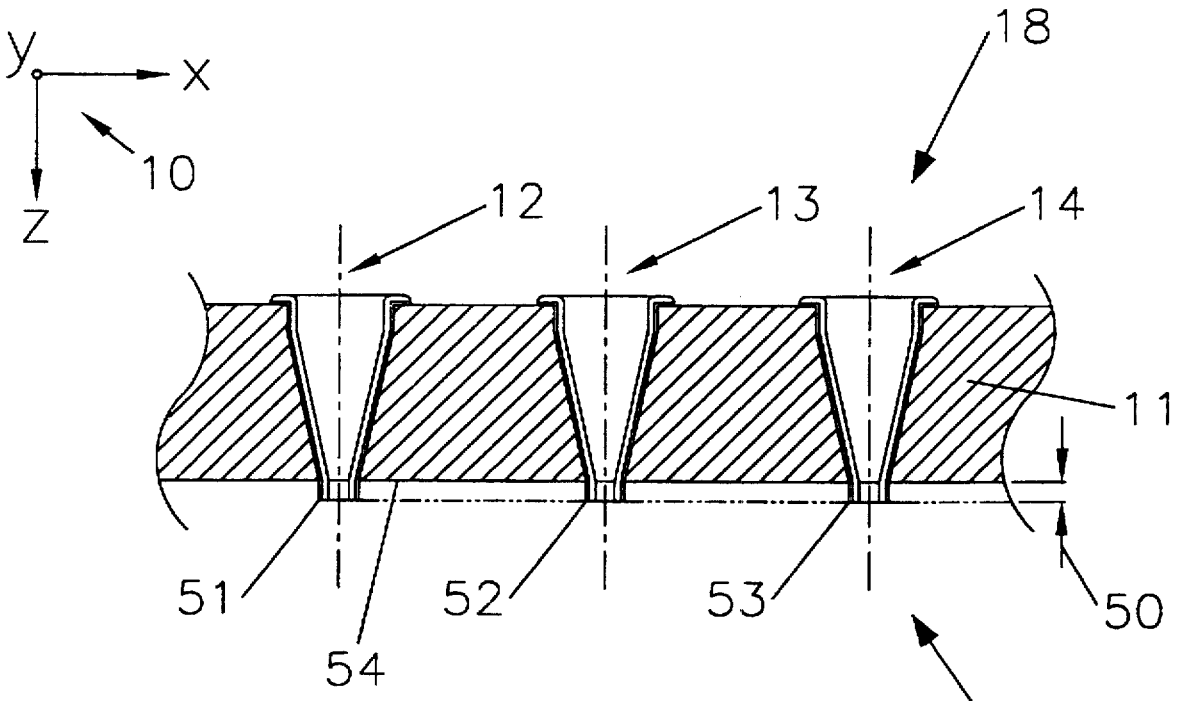
FIG. 7 is a side view of the substrate of FIG. 6, wherein the ink exit side of the substrate has been full surface etched to remove a depth of that side of the substrate, thus leaving a short, and generally circular, cylinder-shaped metal extension for each of the three cone-shaped metal nozzles, these three metal extensions extending beyond the now-etched ink exit side of the substrate by a common amount that is equal to amount of the substrate that was removed by the full surface etching thereof.

FIG. 7 is a side view of a completed substrate 11 after the ink exit side 16 of substrate 11, as seen in FIG. 6, has been full surface lapped, and then etched to remove a uniform substrate depth 50 from that side of substrate 11. By way of example only, in an embodiment of the invention dimension 50 is about 0.005-inch. As a result of this full surface etching of substrate 11, each of the metal nozzle cones 12,13,14 is left with a relatively short, and generally circular-cylinder-shaped metal extension 51,52,53. The metal extensions 51,52,53 extend axial relative to metal nozzle cones 12,13, 14, and generally correspond to metal circular cylinder portions 15 that were above-described relative to FIG. 2. Metal extensions 51,52,53 extend beyond the now-etched surface 54 of substrate 11 by an amount that is equal to the amount 50 of substrate 11 that was removed by the full surface etching of the substrate's exit side 16. Examples of well-known techniques that may be used to remove portion 50 of substrate 11 include plasma etching, E-beam etching, and Reactive Ion Etching (RIE).

In an embodiment of the invention, the exterior surfaces of metal extensions 51,52,53; i.e., the metal surfaces that are exposed by removal of the portion 50 of substrate 11, were then coated with a thin layer of gold.

Figure 8:
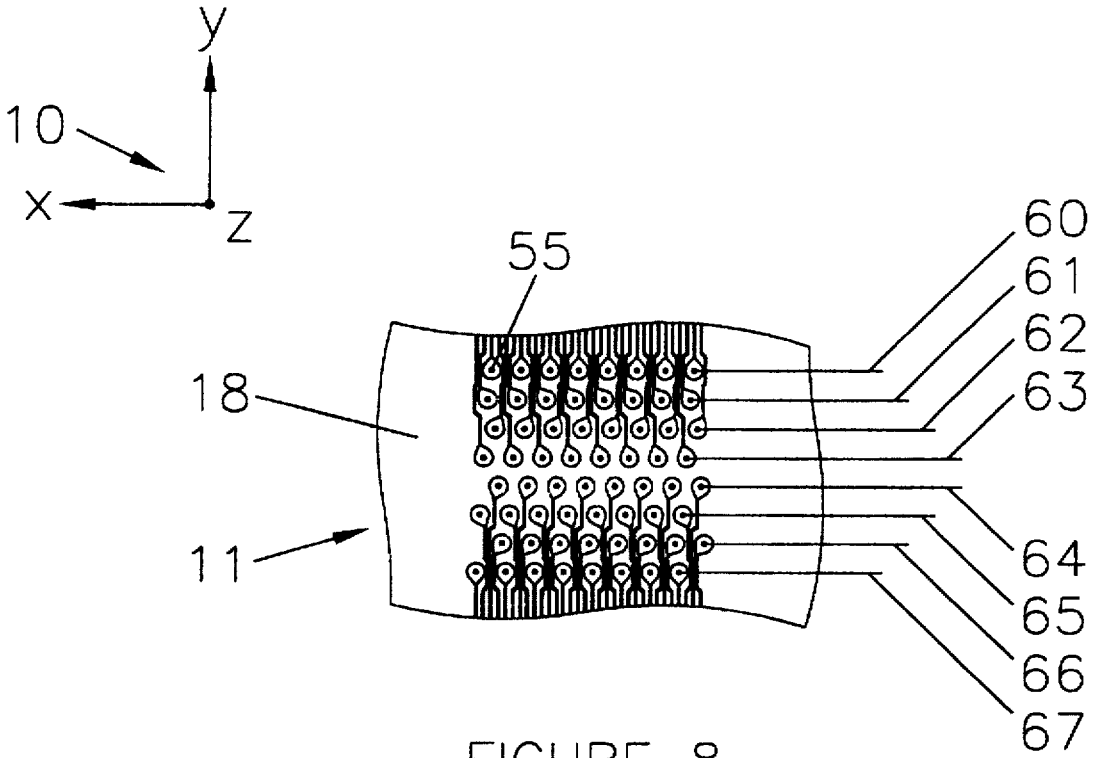
FIG. 8 is a top or ink entry surface view of a substrate such as shown in FIG. 7, wherein the substrate contains a multi-nozzle array of nozzles arranged in an X-Y matrix array.
Figure 9:
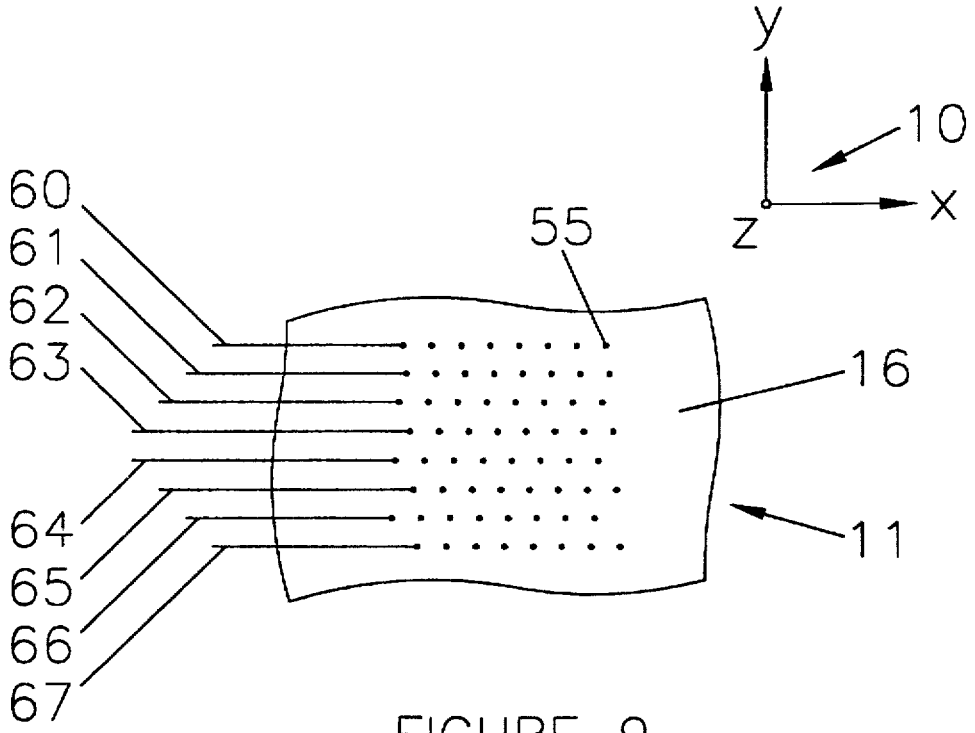
FIG. 9 is a bottom or ink exit surface view of the multi-nozzle substrate of FIG. 8.

As stated previously, a substrate 11 in accordance with the present invention, and fabricated as described above, may contain a multi-nozzle X-Y array having a relatively large number of individual metal nozzles cones, each individual cone of which is of the type 12,13,14 above described. FIG. 8 is a top view, or ink entry surface 18 view, of such an X-Y nozzle array, and FIG. 9 is a bottom view, or ink exit surface 16 view, of the X-Y nozzle array of FIG. 8. In FIGS. 8 and 9, one of the many individual nozzles within substrate 11 is identified by numeral 55.

In this exemplary showing of a multi-nozzle substrate 11, eight X direction nozzle rows 60–67 are shown, these eight rows being identified by X direction lines 60–67 in FIGS. 8 and 9. While such a substrate 11 actually contains a relatively large number of Y direction nozzle columns, for purposes of simplicity, only a limited number of nozzle columns are shown in FIGS. 8 and 9, the physical position of these columns being provided by X direction staggering of the nozzles 55 that are within the eight nozzle rows 60–67.

A multi-nozzle substrate 11 in accordance with the present invention can be constructed and arranged to facilitate selective control of the multiple nozzles, therein by using well-known control signal multiplexing techniques. In this embodiment of the invention, substrate 11 again is fabricated, as described above, to contain a multi-nozzle X-Y nozzle array having a relatively large number of individual metal nozzles cones, each individual cone of which is of the type 12,13,14 above described.

Figure 10:
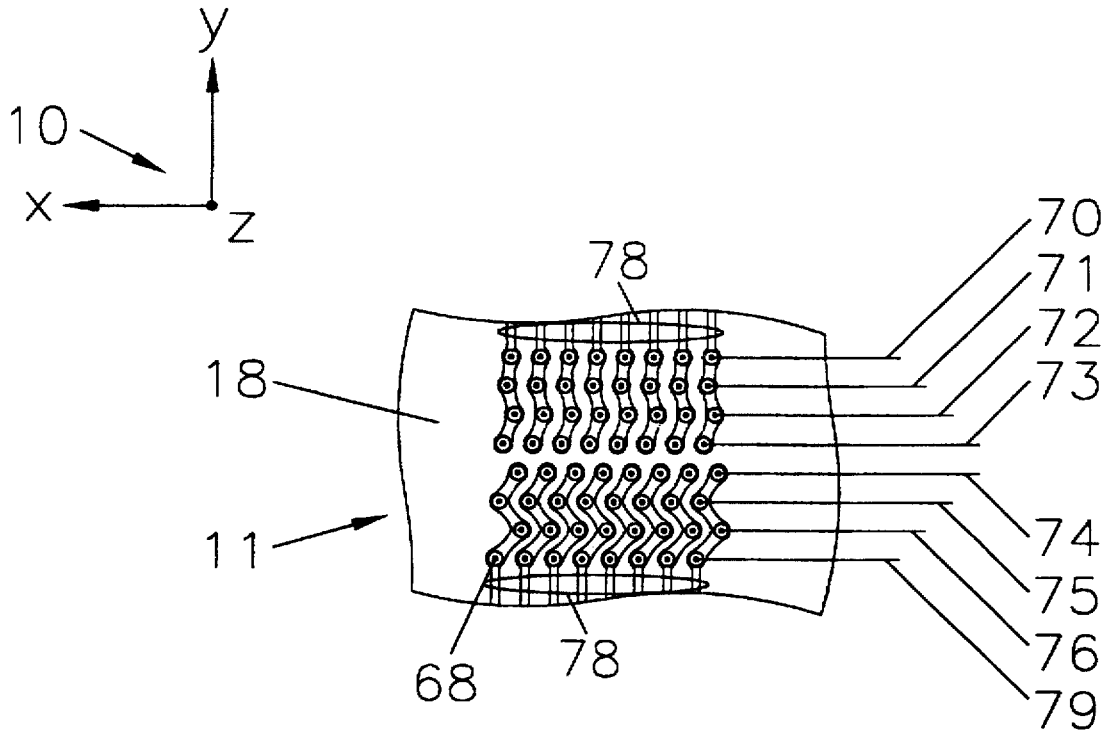
FIG. 10 is a top or ink entry surface view of a signal multiplexing X-Y nozzle array in accordance with the invention.
Figure 11:
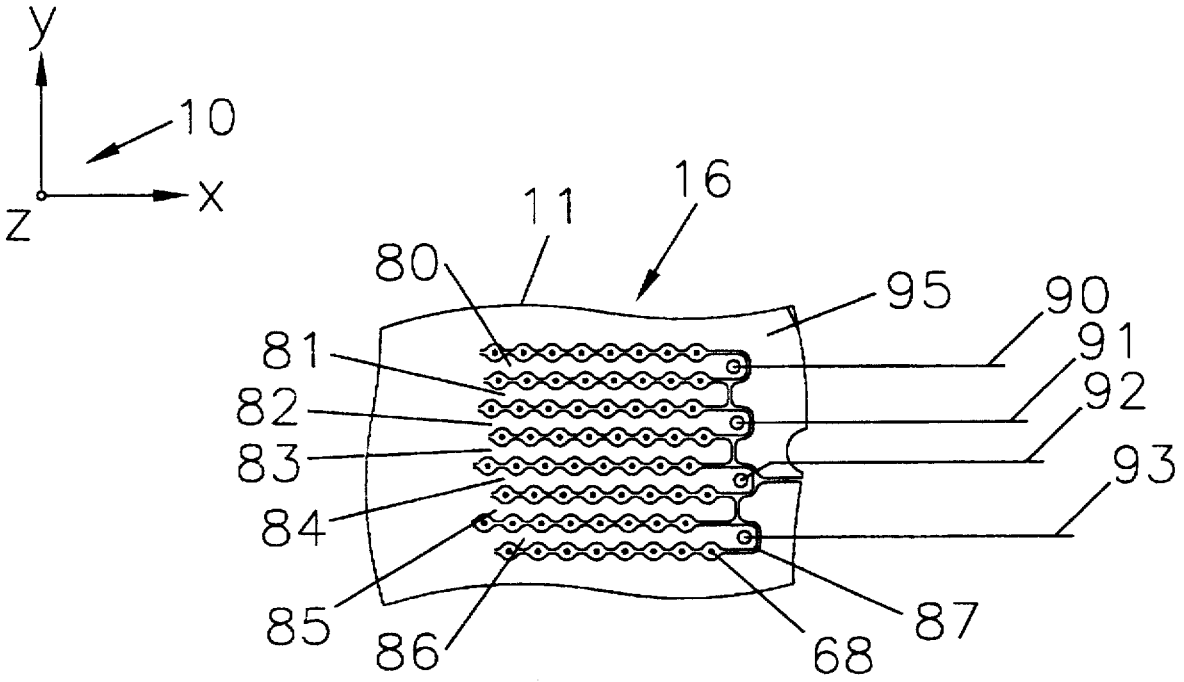
FIG. 11 is a bottom or ink exit surface view of the signal multiplexing X-Y nozzle array of FIG. 10.

FIG. 10 is a top view, or ink entry surface 18 view, of such a signal multiplexing X-Y nozzle array. FIG. 11 is a bottom view, or ink exit surface 16 view, of the X-Y nozzle array of FIG. 10. In FIGS. 10 and 11, one of the many individual nozzles that are within substrate 11 is identified by numeral 68.

In this exemplary showing of a multi-nozzle substrate 11 that facilitates signal multiplexing to select any given nozzle or nozzles 68 for the printing of a page pixel or pixels, eight X direction nozzle rows 70–77 are shown, these eight rows being identified by X direction lines 70–77 in FIGS. 10 and 11. While substrate 11 of FIGS. 10 and 11 actually contains a relatively large number of Y direction nozzle columns, for purposes of simplicity, only a limited number of nozzle columns are shown in FIGS. 10 and 11, the physical position of these columns being provided by X direction staggering of the nozzles 68 that are within the eight nozzle rows 70–77.

In this embodiment of the invention, the X direction nozzle rows are signal-controlled by a number of row-selection electrical conductors that are all located on the ink entry side 18 of substrate 11, and that are all collectively identified by one reference numeral 78 in FIG. 10. As shown, each individual one of the conductors 78 electrically connects to four nozzles 68 that reside in four different ones of the X direction nozzle rows 70–77. As will be apparent to those of skill in the art, conductors 78 are fabricated, or manufactured, in accordance with the invention using the techniques that are above-described relative to FIGS. 3 and 4.

In order to facilitate signal multiplexing, or more specifically, the selection of only specific ones of the many nozzles 68 for pixel printing, the ink exit side 16 of substrate 11, as shown in FIG. 11, is fabricated, as above described, to contain seven column-selection metal electrical conductors 80–86 that physically extend in the X direction. As is well known, in order to select specific nozzles 68 for printing, multiplexing column-selection control signals are connected to conductors 80–86, in synchronism with connecting multiplexing row-selection control signals to conductors 78 of FIG. 10. More specifically, in order to select any nozzle 68 for printing, that nozzles conductor 78 must be activated, and the two conductors 80–86 that lie on opposite side of that nozzle must both be activated.

For purposes of explanation of FIG. 11, it is important to note that the small physical gap areas that do not contain metal, and that are identified at one point by the reference number 87, comprise an electrically insulating gap through which the ink exit side 16 of electrically insulating substrate 11 may be viewed. In FIG. 11, the four conductors 80,82, 84,86 are shown as each being provided with an individual electrical conductor signal 90,91,92,93 to which column-selection control signals are applied. The remaining conductors 81,83,85 are likewise provided with an individual column-selection conductor; for example, at the left hand side of FIG. 11, not shown therein.

In addition, in accordance with the above-mentioned copending patent application incorporated herein by reference, the ink exit side 16 of substrate 11, shown in FIG. 11, is preferably provided with a metal field compensation electrode 95, as is described in that copending patent application. Again, as will be appreciated by those of skill in the art, electrode 95 is deposited on the ink exit side 16 of substrate 11 using the techniques that are above-described relative to FIGS. 2–6.

Figure 12:
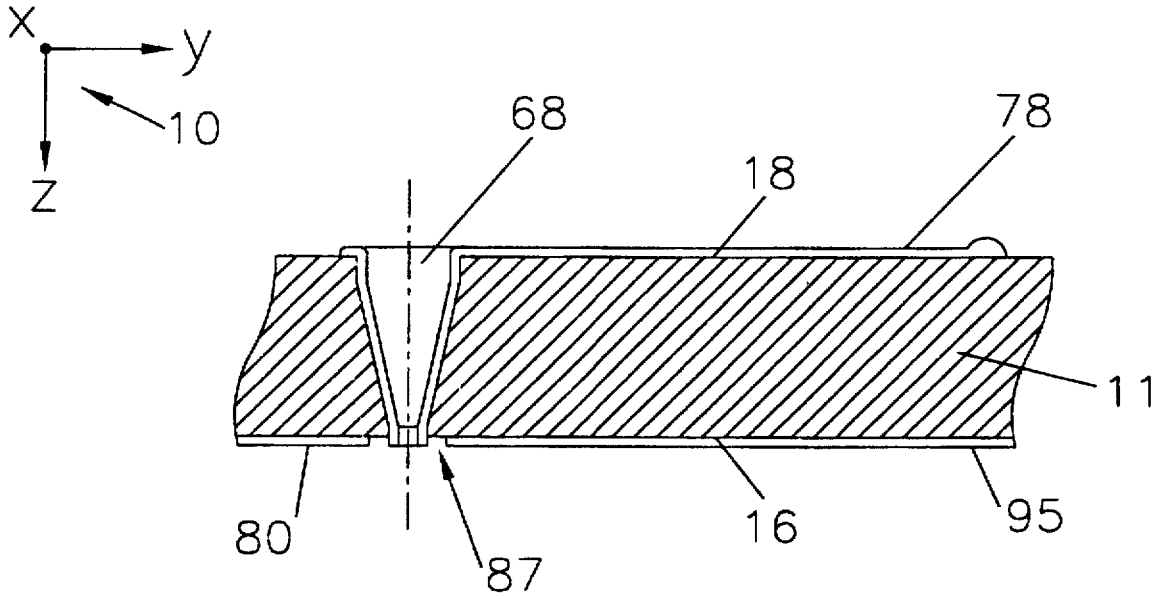
FIG. 12 is an enlarged side view of an edge portion of the multiplexing X-Y nozzle array of FIGS. 10 and 11.

FIG. 12 is an enlarged side view of a portion of the substrate 11 that is shown in FIGS. 10 and 11. In FIG. 12, one of the array-edge-located nozzles 68 that is within outer nozzle row 70 is shown in physical relation to both that nozzle's row-selection control conductor 78 and that nozzles's column-selection control conductor 80, as well as that nozzle's closely adjacent field compensation electrode 95.

Figure 13:
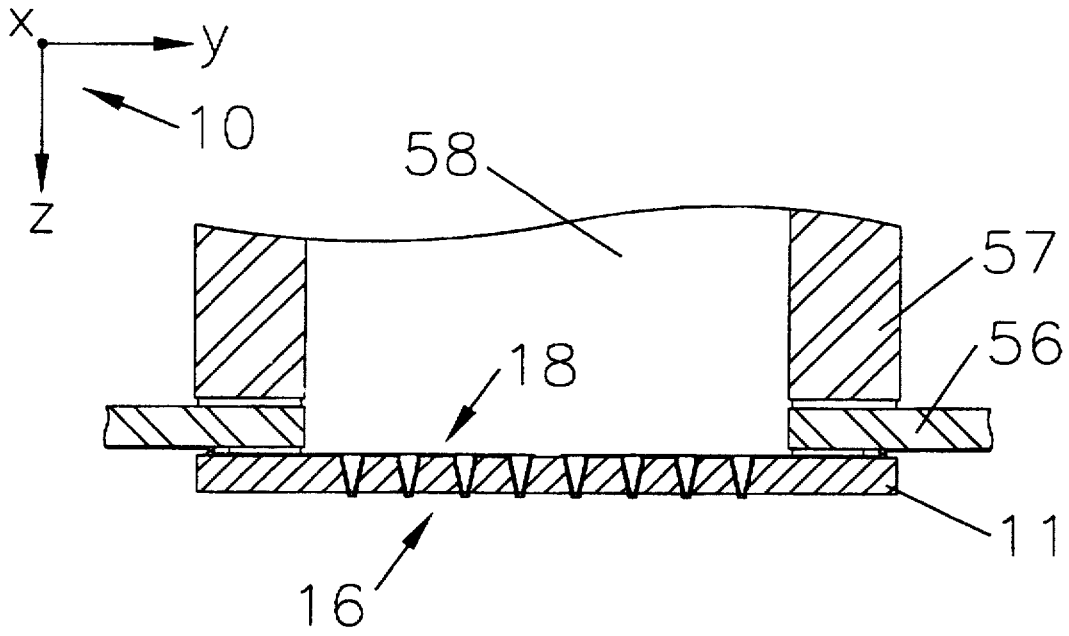
FIG. 13 is a side view of a printhead of the invention, whereby the nozzle substrate of FIG. 7, or the nozzle substrate of FIGS. 8 and 9, or the nozzle substrate of FIGS. 10, 11 and 12, is provided with a printing ink that is contained in a reservoir that is in communication with the ink entry side of the substrate.

In use of the nozzle cone substrate 11 of FIG. 7, or the substrate 11 of FIGS. 8 and 9, or the substrate 11 of FIGS. 10, 11 and 12, the substrate is provided with an ink that is contained in a reservoir that is located closely adjacent to, or in close communication with, the ink entry side 18 of the substrate. FIG. 13 is a side view of such an arrangement. In FIG. 13 substrate 11 is supported by, and physically sealed to, a Printed Circuit Board (PCB) 56, or to a similar structural member, that surrounds and structurally supports all four sides of substrate 11, leaving the center and nozzle-active portion of substrate 11 exposed both on its ink entry side 18, and on its ink exit side 16. PCB 56 operates to facilitate the connection of electrical control signals to the electrical conductors that are carried by the ink entry side 18 of substrate 11.

A four-wall, closed top container, or housing 57, is sealed to PCB 56. Printing ink, usually under ambient pressure, is supplied in a well-known manner to a reservoir 58 that is defined by housing 57, PCB 56, and substrate 11.

As stated previously, in accordance with a feature of this invention, multi-nozzle printhead substrate members as above described can also be made using well-known semiconductor processing techniques. FIGS. 14–18 provide a teaching of such a multi-nozzle substrate in accordance with the invention.

Figure 14:
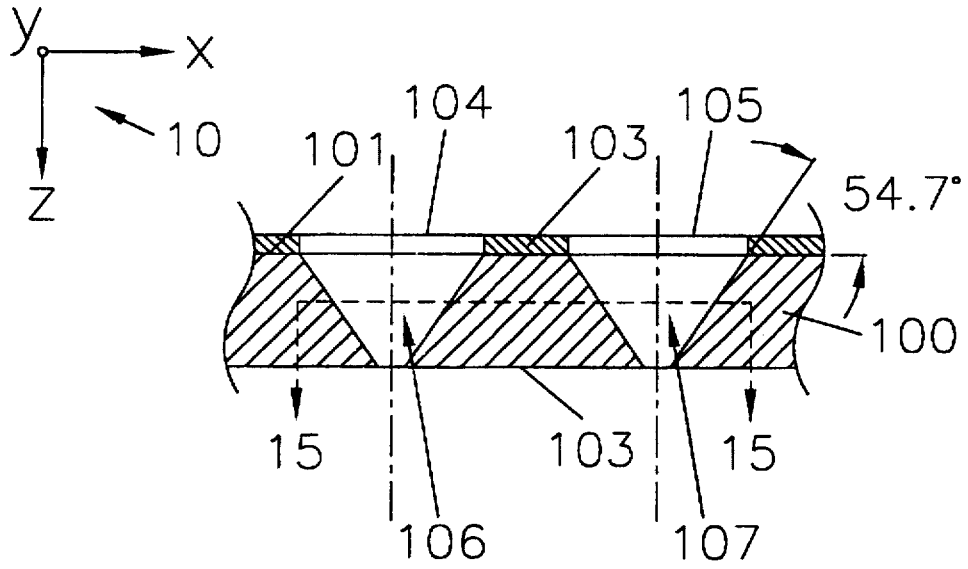
Figure 15:
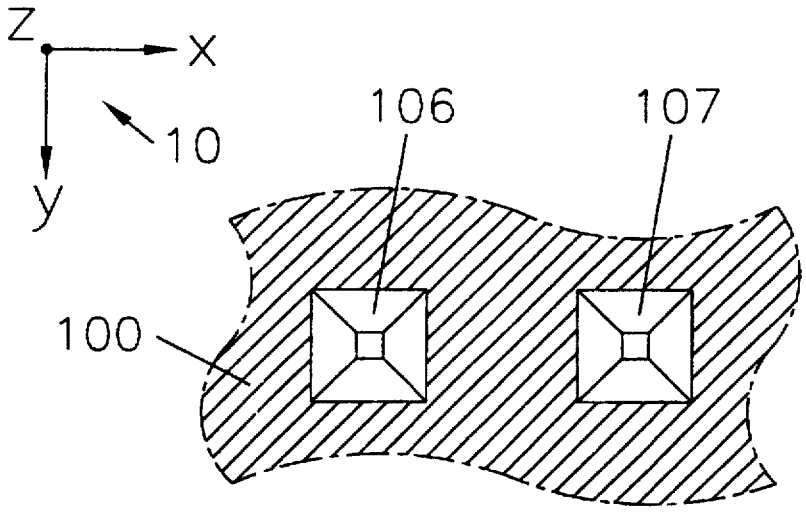

FIG. 14 is a side view of a thin, flat, silicon semiconductor substrate 10 having a flat and X-Y planar ink entry side 101 that is parallel to flat and X-Y planar ink exit side 102. In FIG. 14, a photoresist layer 103 has been coated on ink entry surface 101 in such a manner to leave two circular voids 104,105 in photoresist layer 103. By means of well-known silicon etching techniques, square cross-section nozzle holes 106,107 are then produced in substrate 101. The square cross-sectional shape of each of the nozzle holes 106,107 is shown in FIG. 15, FIG. 15 being a section view of nozzle hole 106 as shown in FIG. 14.

Figure 16:
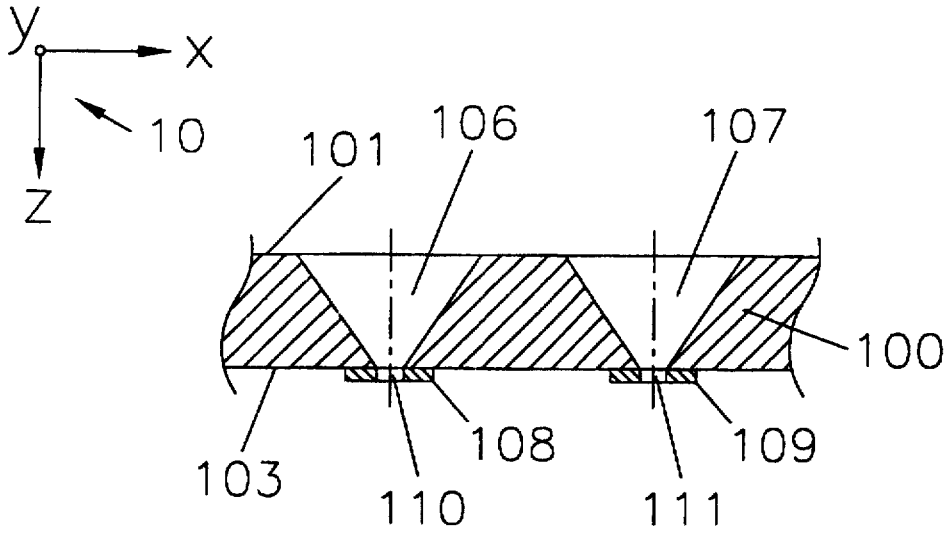

FIG. 16 shows the silicon substrate 100 of FIG. 14 after photoresist layer 103 has been removed from ink entry side 101, and after two donut-shaped photoresist disks 108 and 109 have been placed on the ink exit side 103 of silicon substrate 100. As shown in FIG. 16, each of the two photoresist disks 108,109 may include a square-shaped central opening 110,111 that is located to be axially coincident with the square ink exit shape of nozzle hole 106,107, respectively.

Figure 17:
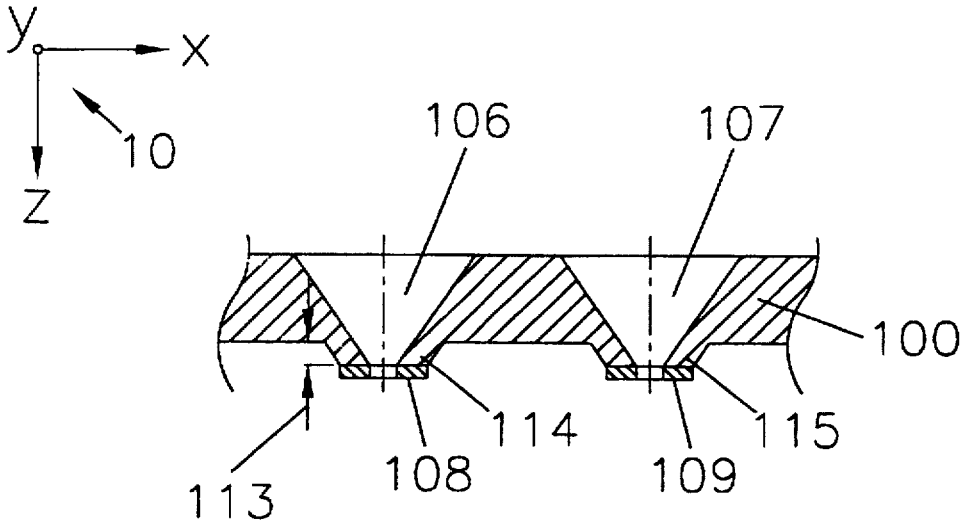

FIG. 17 shows the silicon substrate 100 of FIG. 16 after well-known silicon etching techniques have been used to remove a depth 113 of silicon substrate 100, to thereby form a generally annular shaped silicon protrusion 114,115 at the ink exit ends of each of the respective nozzle holes 106,107.

Figure 18:
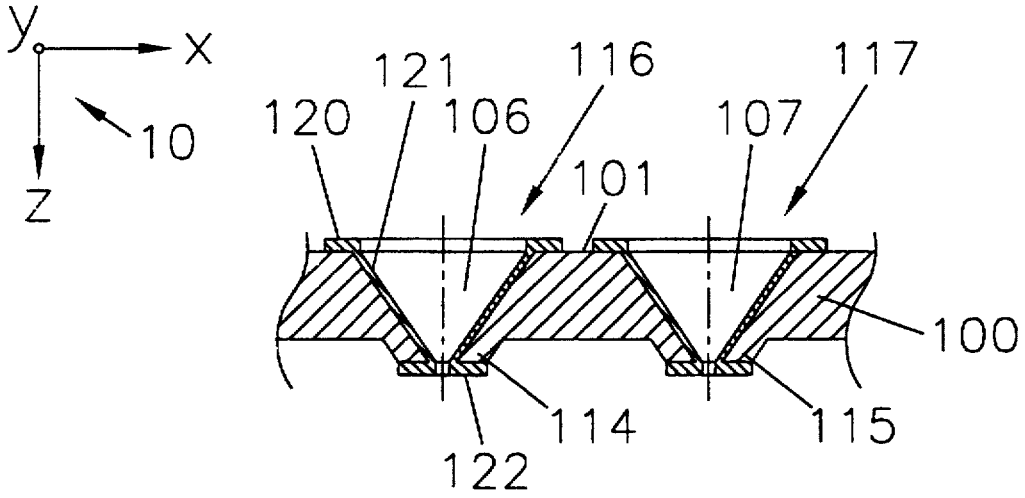
Figure 19:
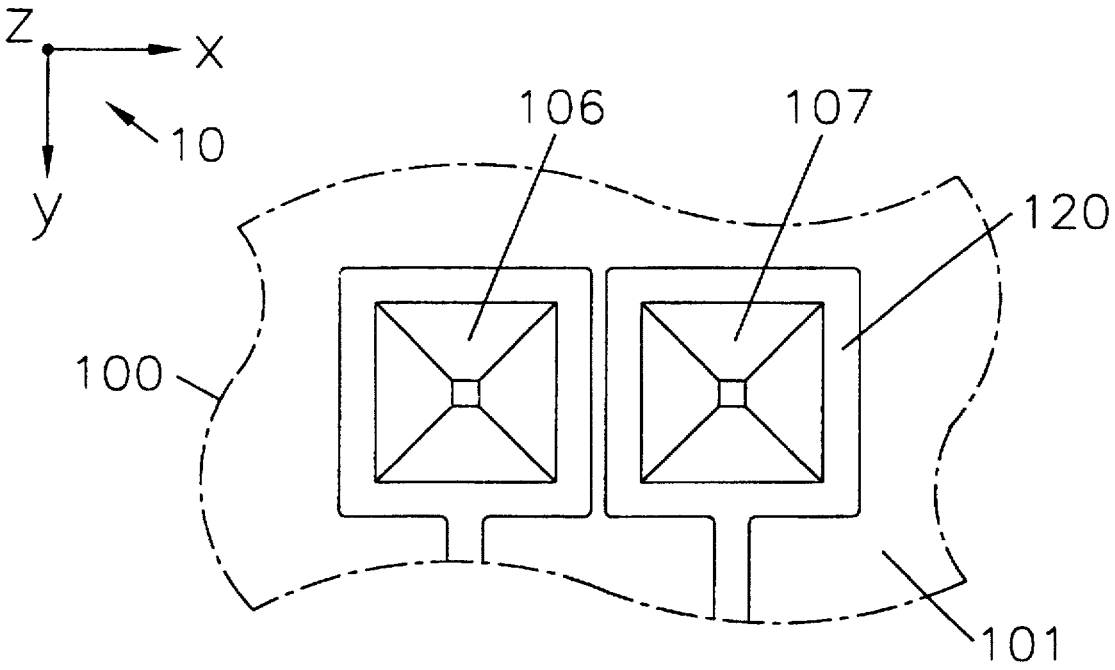

FIG. 18 shows a finished silicon substrate 100, wherein the photoresist disks 108,109 of FIG. 17 have been removed, and wherein two metal nozzles 116,117 have been plated on silicon substrate 100 at the respective locations of the two nozzles holes 106,107. As seen in FIG. 18, each of the two metal nozzles 116,117 comprise a disk-shaped metal portion 120 that is coincident with the ink entry side 101 of substrate 100, a square cross section cone-shaped metal portion 121, and a disk-shaped metal portion 122 that is coincident with the ink exit side of each of the two silicon protrusions 114,115. The metal nozzles 116,117 may comprise nickel-cobalt upon which a thin layer of gold has been plated.

As with the above-described multi nozzle substrates, substrate 100 of FIG. 18 is also intended for use as above described in relation to FIG. 13, and substrate 100 may, if desired, be constructed to facilitate multiplex control of a large number of metal nozzles, as above described.

In the above description of preferred embodiments of this invention, the various embodiments provide that the described metal ink jet nozzles will terminate at a nozzle-extension that extends a distance beyond the ink exit side of the substrate (for example, see metal extensions 51,52,53 and distance 50 of FIG. 7). This feature of the invention insures that the ink that resides in all of the various printhead nozzles will not undesirably wet the adjacent surface of the substrates ink exit side. As a feature of the invention, this distance 50 is selected as a function of the small X-Y cross-sectional area of these nozzle terminations, and the physical properties of the ink that is used in the printhead. More specifically, when these nozzle extensions are of a circular cross section, this distance 50 is selected as a function of the diameter of the circular cross section, and more specifically, this distance 50 is selected to be generally equal to the diameter of the circular cross section.

The present invention has been described while making reference to preferred embodiments thereof. Since those skilled in the art will readily visualize yet other embodiments that are within the spirit and scope of the present invention, the above detailed description is not to be taken as a limitation on the spirit and scope of this invention.

What is claimed is:

1. A method of making an electrostatic ink jet head having a plurality of ink jet nozzles, comprising the steps of:

providing a flat, electrically nonconductive, and rigid plastic plate having a plurality of physically spaced nozzle holes formed therein;

a top flat surface of said plate comprising an ink entry side, and a bottom flat surface of said plate comprising an ink exit side that is parallel to said ink entry side;

each individual one of said nozzle holes being formed as a cone having an interior surface that extends through said plate from said entry side to said exit side, a wide portion that is located at said entry side, and a narrow portion that is located at said exit side;

forming (1) a plurality of first areas of a first metal on said entry side of said plate, each individual one of said first areas of said first metal surrounding one of said plurality of nozzle holes, (2) a plurality of second areas of said first metal on said entry side of said plate, each individual one of said second areas of said first metal extending away from an individual one of said first areas of said first metal, and (3) a plurality of third areas of said first metal, each individual one of said third areas of said first metal being located on an individual one of said interior surfaces of said plurality of nozzle holes, and each individual one of said third areas of said first metal being connected to an individual one of said second areas of said first metal;

plating a second metal on said first, second and third plurality of areas of said first metal;

processing said exit side of said plate in a manner to remove a portion of said exit side of said plate, and to thereby provide a metal extension for each of said plurality of nozzle holes extending beyond said exit side of said plate, and providing an ink reservoir on said ink entry side of said plate, said reservoir being in ink-flow communication with said wide portion of said plurality of ink jet nozzle holes.

2. The method of claim 1 wherein said processing step comprises the steps of:

lapping said exit side of said plate; and thereafter etching said exit side of said plate to thereby remove said portion of said exit side of said plate.

3. The method of claim 1 wherein said first metal comprises a chromium flash that is covered by cooper, and wherein said second metal comprises a nickel-cobalt alloy having gold thereon.

4. The method of claim 3 wherein said processing step comprises the steps of:

lapping said exit side of said plate; and thereafter etching said exit side of said plate to thereby remove said portion of said exit side of said plate.

5. A method of making an electrostatic ink jet head having a flat X-Y nozzle matrix consisting of a plurality of individual and physically spaced ink jet nozzles, comprising the steps of:

providing a flat and electrically nonconductive substrate having said plurality of ink jet nozzle holes formed therein, said plastic substrate having a flat ink entry surface and a flat ink exit surface that is generally parallel to said ink entry surface;

each individual one of said plurality of nozzle holes being formed as a tapered hole having a wide-area portion that is coincident with said entry side, and having a narrow-area portion that is coincident with said exit side;

coating a first metal on all surfaces of said substrate;

covering said first metal coating with a photoresist;

selectively exposing and then removing said photoresist on said entry side to form an exposed border of said first metal surrounding each individual one of said nozzle holes generally coincident with said wide-area portion, to form an exposed electrical conductor of said first metal connecting to each of said exposed borders, and to form an exposed cone-shape of said first metal coincident with each of said nozzle holes;

plating a second metal on said exposed first metal;

removing said first metal in thereof areas that are not plated with said second metal;

lapping said exit side;

etching said substrate on said exit side in a manner to remove a uniform thickness of said exit side of said substrate, and to thereby provide a metal projection for each of said nozzle holes that extends beyond said exit side of said substrate, and providing an ink reservoir on said entry side of said substrate.

6. The method of claim 5 wherein said substrate comprises polycarbonate, wherein said first metal comprises a chromium/cooper layer, and wherein said second metal comprises a nickel/cobalt layer.

7. The method of claim 5 including the step of:

plating a metal field-compensation-electrode on said exit side of said substrate in a manner to physically surround the X-Y matrix of said metal projections of said X-Y matrix of nozzles.

8. The method of claim 7 wherein said substrate comprises polycarbonate, wherein said first metal comprises a chromium/cooper layer, wherein said second metal comprises a nickel/cobalt layer, and wherein said field-compensation-electrode comprises a nickel/cobalt layer that is coated with a gold layer.

9. An ink jet nozzle plate having a plurality of physically spaced ink nozzles, comprising:

a flat, electrically nonconductive substrate having a plurality of physically spaced and generally identically shaped nozzle holes extending through said substrate;

a top flat surface of said substrate comprising an ink entry side, and a bottom flat surface of said substrate comprising an ink exit side that is generally parallel to said ink entry side;

each individual one of said plurality of nozzle holes having an interior surface, and each individual one of said plurality of nozzle holes having a large area that is locate adjacent to said ink entry side, and having a small area that is located adjacent to said ink exit side;

each individual one of said plurality of nozzle holes having a central axis that extends generally perpendicular to said ink entry side and to said ink exit side;

a plurality of individual first metal portions on said ink entry side, one first metal portion for each of said nozzle holes, and each individual one of said first metal portions being physically spaced and electrically insulated from a remainder of said first metal portions;

each of said first metal portions having a first metal area that generally surrounds said large area of one of said nozzle holes, and each of said first metal portions having a second metal area that is connected to one of said first metal areas and extends therefrom to provide an electrical signal conductor for said one nozzle hole;

a plurality of individual second metal portions, each individual one of said second metal portions coating said interior surface of one of said nozzle holes, and each individual one of said second metal portions being formed as a unit with one of said first metal areas; and a plurality of individual third metal portions extending a common distance beyond said ink exit side, each individual one of said third metal portions being formed as a unit with one of said second metal portions.

10. The ink jet nozzle plate of claim 9 wherein:

said substrate is a polycarbonate substrate; and said first, second and third metal portions are a nickel-cobalt alloy.

11. The ink jet nozzle plate of claim 9 wherein said plurality of nozzle holes comprise a nozzle hole array having edge nozzle holes that are on an edge of said array, and including:

a fourth metal portion on said exit side of said substrate, said fourth metal portion being adjacent to, but electrically insulated from, said third metal portion of said edge nozzle holes that are on said edge of said array; and said fourth metal portion comprising a field compensation electrode for said edge nozzle holes that are on said edge of said array.

12. The ink jet nozzle plate of claim 4 wherein:

said substrate is a polycarbonate substrate; and said first, second and third metal portions are a nickel-cobalt alloy.

13. A method of making a nozzle plate usable in an multi-nozzle ink jet head having a plurality N of physically spaced and individually controllable ink jet nozzles, comprising the steps of:

providing an electrically nonconductive and structurally stable substrate;

forming a plurality N of physically spaced nozzle holes individually extending through said substrate from an ink entry side to an ink exit side, each of said nozzle holes having an interior surface, and each of said nozzle holes being formed as a tapered hole having a large cross section area that is locate adjacent to said ink entry side and a small cross sectional area that is located adjacent to said ink exit side;

providing a plurality N of first metal areas on said ink entry side, each of said first metal areas being positioned coincident with said large cross section area of one of said nozzle holes;

providing a plurality N of second metal areas on said ink entry side, each of said second metal areas being physically continuous with one of said first metal areas;

providing a plurality N of third metal areas, each of said third metal areas being located on one of said interior surfaces of said nozzle holes, and each of said third metal areas being physically continuous with one of said first metal areas;

providing a plurality N of tubular metal extensions, each of said metal extensions being located coincident with a one of said smaller areas of said nozzle holes and being physically continuous with a one of said third metal portions, and said plurality N of tubular extensions extending a common distance beyond said ink exit side of said substrate; and selecting said common distance as a function of said small cross sectional area.

14. The method of claim 13 wherein said substrate is selected from the group plastic and silicon.

15. The method of claim 13 wherein said substrate is polycarbonate, and wherein said first metal areas, said second metal areas, said third metal areas, and said metal extensions are formed of a nickel-cobalt alloy.

16. The method of claim 13 wherein said plurality N of nozzle holes comprise a two dimensional nozzle array having edge nozzles that are located at a physical edge of said array, and including the step of:

providing a fourth metal portion on said ink exit side of said substrate, said fourth metal portion surrounding, and being electrically insulated from, said certain nozzles that are located at said physical edge of said array.

17. The method of claim 13 including the step of:

providing an ink reservoir on said ink entry side of said substrate in fluid flow communication with said large cross sectional area of said plurality N of nozzles.

18. The method of claim 13 wherein:

said tapered holes comprise circular cross section conical holes having a large diameter located adjacent to said ink entry side and having a small diameter located adjacent to said ink exit side;

said tubular metal extensions having a circular cross section of a diameter generally equal to said small diameter; and said common distance is selected as a function of said small diameter.

19. The method of claim 18 wherein said common distance is generally equal to said small diameter.

20. The method of claim 19 wherein said first, second and third metal areas, and said metal extensions all have a gold exterior surface.

21. A method of making an ink jet head having a plurality N of physically spaced ink jet nozzles, comprising the steps of:

providing an electrically nonconductive, generally flat, and structurally stable substrate, said substrate having a generally flat ink entry surface and a generally flat ink exit surface;

forming a plurality N of physically spaced nozzle holes extending through said substrate from said ink entry surface to said ink exit surface, each of said nozzle holes having an interior surface, and each of said nozzle holes being formed as a tapered hole having a large cross section area that is locate adjacent to said ink entry surface and a small cross sectional area that is located adjacent to said ink exit surface;

providing an ink reservoir on said ink entry surface in fluid flow communication with said large cross section area of said plurality N of nozzles holes;

providing a plurality N of first metal portions, each of said first metal portions being located on one of said interior surfaces of said nozzle holes, and each of said first metal portions extending from said ink entry surface to said ink exit surface;

providing a plurality N of tubular metal extensions, each of said metal extensions being located coincident with one of said small cross section areas of said nozzle holes and being physically continuous with one of said first metal portions, and said plurality N of tubular metal extensions extending a common distance beyond said ink exit surface; and said common distance being selected as a function of said small cross section area.

22. The method of claim 21 wherein said substrate is selected from the group plastic, ceramic and silicon.

23. The method of claim 21 wherein said substrate is polycarbonate, and wherein said first metal portions and said tubular metal extensions are formed of a nickel-cobalt alloy.

24. The method of claim 21 wherein said plurality N of nozzle holes comprise a two dimensional nozzle array having edge nozzles that are located at a physical edge of said array, and including the step of:

providing a second metal portion on said ink exit surface, said second metal portion surrounding and being electrically insulated from said certain nozzles located at said physical edge of said array.

25. The method of claim 21 wherein:

said tapered holes comprise circular cross section conical holes having a large diameter located adjacent to said ink entry surface and having a small diameter located adjacent to said ink exit surface;

said tubular metal extensions having a circular cross section of a diameter generally equal to said small diameter; and said common distance being selected as a function of said small diameter.

26. The method of claim 25 wherein said common distance is generally equal to said small diameter.

27. The method of claim 22 wherein said first metal portions and said tubular metal extensions include a gold exterior surface.

28. An ink jet head having a plurality of physically spaced nozzles, comprising:

a flat and electrically nonconductive substrate having an ink entry surface and an ink exit surface that is generally parallel to said ink entry surface;

a plurality of physically spaced and generally identically shaped nozzle holes extending through said substrate from said ink entry surface to said ink exit surface;

each of said nozzle holes having an interior surface;

each of said nozzle holes having a large area that is locate adjacent to said ink entry surface;

each of said nozzle holes having a small area that is located adjacent to said ink exit surface;

each of said nozzle holes having a central axis that extends generally perpendicular to said ink entry surface and said ink exit surface;

an ink reservoir on said ink entry surface in ink-flow communication with said large area of said nozzle holes;

a plurality of individual first metal portions;

each of said first metal portions coating a said interior surface of one of said nozzle holes;

a plurality of tubular metal extensions extending a common distance beyond said ink exit surface; and each of said tubular metal extensions being formed as a unit with one of said first metal portions.

29. The ink jet head of claim 28 wherein: said substrate is a polycarbonate substrate; and said first metal portions and tubular metal extensions are a nickel-cobalt alloy.

30. The ink jet head of claim 24 wherein said plurality of nozzle holes comprise a nozzle hole array having certain nozzle holes that are on an edge of said array, and including:

a second metal portion on said exit surface;

said second metal portion being adjacent to, but electrically insulated from, said tubular metal extensions of said edge nozzle holes that are on said edge of said array;

said second metal portion comprising a field compensation electrode for said edge nozzle holes that are on said edge of said array.

* * * * *